US007448136B2

(12) United States Patent
Huang

(10) Patent No.: US 7,448,136 B2
(45) Date of Patent: Nov. 11, 2008

(54) UTILITY KNIFE

(76) Inventor: Yin Han Huang, No. 4, Lane 342, Pengyii Road, Taiping City, Taichung Hsien 41146 (TW)

( * ) Notice: Subject to any disclaimer, the term of this patent is extended or adjusted under 35 U.S.C. 154(b) by 154 days.

(21) Appl. No.: 11/448,311

(22) Filed: Jun. 7, 2006

(65) Prior Publication Data

US 2007/0283570 A1 Dec. 13, 2007

(51) Int. Cl.
*B26B 1/08* (2006.01)

(52) U.S. Cl. ..... 30/125; 30/162

(58) Field of Classification Search ..... 30/2, 30/124, 125, 162, 335
See application file for complete search history.

(56) References Cited

U.S. PATENT DOCUMENTS

| | | | | |
|---|---|---|---|---|
| 4,277,888 | A * | 7/1981 | Szabo | 30/162 |
| 4,761,882 | A * | 8/1988 | Silverstein | 30/162 |
| 5,435,062 | A | 7/1995 | Huang | 30/125 |
| 6,192,589 | B1 | 2/2001 | Martone et al. | 30/125 |
| 6,249,975 | B1 * | 6/2001 | Lin | 30/162 |
| 6,446,340 | B1 * | 9/2002 | Ping | 30/125 |
| 6,553,674 | B1 * | 4/2003 | Budrow | 30/162 |
| 6,742,261 | B2 * | 6/2004 | Ho | 30/162 |
| 6,829,827 | B2 * | 12/2004 | Tseng | 30/162 |
| 6,886,257 | B2 * | 5/2005 | Chih | 30/125 |
| 2003/0154605 | A1 * | 8/2003 | Chao | 30/162 |
| 2005/0193567 | A1 * | 9/2005 | Ho | 30/162 |
| 2005/0283983 | A1 * | 12/2005 | Huang | 30/162 |
| 2007/0220758 | A1 * | 9/2007 | Ho | 30/162 |

* cited by examiner

*Primary Examiner*—Hwei-Siu C Payer
(74) *Attorney, Agent, or Firm*—Charles E. Baxley

(57) ABSTRACT

A utility knife includes a housing having a compartment for receiving one or more spare knife blades, a blade carrier slidably received in the housing for supporting and moving a knife blade into and out of the housing, and a pushing device for selectively pushing and feeding one of the spare knife blades into the blade carrier without opening or detaching the housing. A pusher is slidably received in the housing and has an edge for engaging with and for moving the spare knife blade to the blade carrier, and a spring element may move the pusher relative to the housing and to offset the pusher from the spare knife blade. A hand grip may be used to move the pusher relative to the housing.

12 Claims, 7 Drawing Sheets

UTILITY KNIFE

BACKGROUND OF THE INVENTION

1. Field of the Invention

The present invention relates to a utility knife, and more particularly to a utility knife including a feeding structure or device for easily pushing or feeding or changing a spare knife blade into a blade carrier.

2. Description of the Prior Art

Typical utility knives comprise a blade carrier slidably received in a handle or housing for carrying and moving knife blade into and out of the handle or housing and for selectively conducting the cutting operation. Some of the typical utility knives further provide a blade box built in the handle or housing for storing spare knife blades.

For example, U.S. Pat. No. 5,435,062 to the present inventor, Huang, discloses one of the typical utility knives comprising a blade box built into the handle or housing for receiving and storing spare knife blades. However, the spare knife blades received and stored within the blade box may not be easily and quickly fed or pushed into the blade carrier and are normally required to be removed from the blade box and then engaged into the blade carrier manually by the users.

U.S. Pat. No. 6,192,589 to Martone et al. discloses another typical utility knife also comprising a blade storage member pivotally connected with the main body and constructed and arranged to carry a supply of spare blades and is movable between a closed position wherein the spare blades are concealed and a fully opened position permitting access to the spare blades.

However, similarly, the spare knife blades received and stored within the blade storage member also may not be easily and quickly fed or pushed into the blade carrier and are also required to be removed from the blade storage member and then engaged into the blade carrier manually by the users.

The present invention has arisen to mitigate and/or obviate the afore-described disadvantages of the conventional spare knife blades feeding device for the utility knives.

SUMMARY OF THE INVENTION

The primary objective of the present invention is to provide a utility knife including a feeding structure or device for easily pushing or feeding or changing a spare knife blade into a blade carrier without opening the handle or housing.

In accordance with one aspect of the invention, there is provided a utility knife comprising a housing including a channel and a front opening formed therein, and including a compartment formed therein for receiving at least one spare knife blade, a blade carrier slidably received in the channel of the housing for supporting and for moving a knife blade into and out of the front opening of the housing, and a pushing device for selectively pushing and feeding the spare knife blade into the blade carrier.

The pushing device includes a pusher slidably received in the housing and having an edge for engaging with the spare knife blade and for moving the spare knife blade to the blade carrier. The pushing device includes a spring element engaged with the pusher for moving the pusher relative to the housing and to offset the pusher from the spare knife blade.

The housing includes a groove formed therein, the pusher includes a member slidably received in the groove of the housing. The housing includes a casing provided therein to form and define the groove thereof. The blade carrier includes a slot formed therein and defined by at least one track rail for slidably receiving the member of the pusher.

The edge of the pusher is an inclined edge. The housing includes a hand grip slidably attached to the housing and secured to the pusher for moving the pusher relative to the housing. The pusher includes a pin extended therefrom and slidably engaged into an oblong hole of the housing and attached to the pusher.

The housing includes a cover attached thereto for enclosing the compartment of the housing and for retaining the spare knife blade within the housing. The cover includes a spring latch for attaching and locking the cover to the housing. The cover includes a spring member for engaging with the spare knife blade and for biasing the spare knife blade against the blade carrier.

The blade carrier includes a recessed space formed therein for receiving and supporting the spare knife blade and includes a spring catch extended into the recessed space of the blade carrier for engaging with the spare knife blade and for anchoring and positioning the spare knife blade to the blade carrier.

The housing includes a disengaging device slidably attached to the housing for engaging with and for selectively disengaging the spring catch from the spare knife blade and for allowing the spare knife blade to be selectively removed from the blade carrier.

The housing includes a number of cavities and a passage formed in the housing and communicating with the channel of the housing, the blade carrier includes an extension extended therefrom and slidably engaged in the passage of the housing for guiding the blade carrier to move relative to the housing, and includes a knob provided on top of the extension for moving the blade carrier relative to the housing, and includes a spring arm having a key extended therefrom for selectively engaging with either of the cavities of the housing and for anchoring and positioning the blade carrier to the housing at selected positions.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
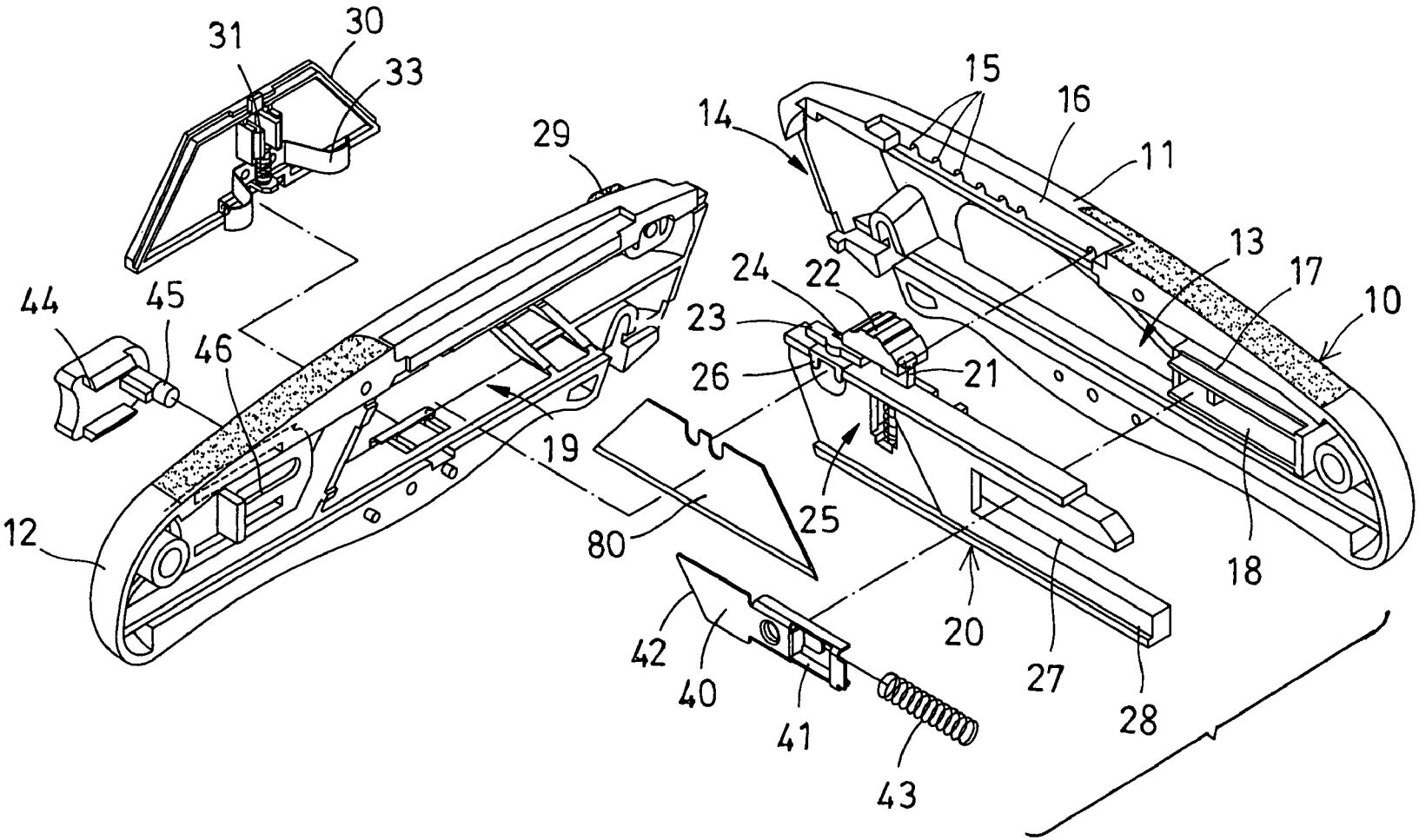
FIG. 1 is a partial exploded view of a utility knife in accordance with the present invention.

Referring to the drawings, and initially to FIGS. 1-5, a utility knife in accordance with the present invention comprises a handle or housing 10 including such as two halves or two housing members 11, 12 which may be detachably or openably secured together with such as latches or fasteners (not shown), and including a channel 13 formed in the housing 10 for slidably receiving a blade carrier 20 therein and for guiding the blade carrier 20 to move toward and away from a front opening 14 of the channel 13 and/or of the housing 10.

The housing 10 includes a number of projections or cavities 15 and a passage 16 formed in the upper portion of the housing 10 and communicating with the channel 13 of the housing 10. The blade carrier 20 includes an extension 21 extended upwardly therefrom and slidably engaged in the passage 16 of the housing 10 for guiding the blade carrier 20 to move relative to the housing 10, and includes a knob 22 provided on top of the extension 21 for moving the blade carrier 20 relative to the housing 10, and includes a spring arm 23 having a key 24 extended therefrom for selectively engaging with either of the cavities 15 of the housing 10 and for anchoring or positioning the blade carrier 20 to the housing 10 at selected positions.

Figure 10:
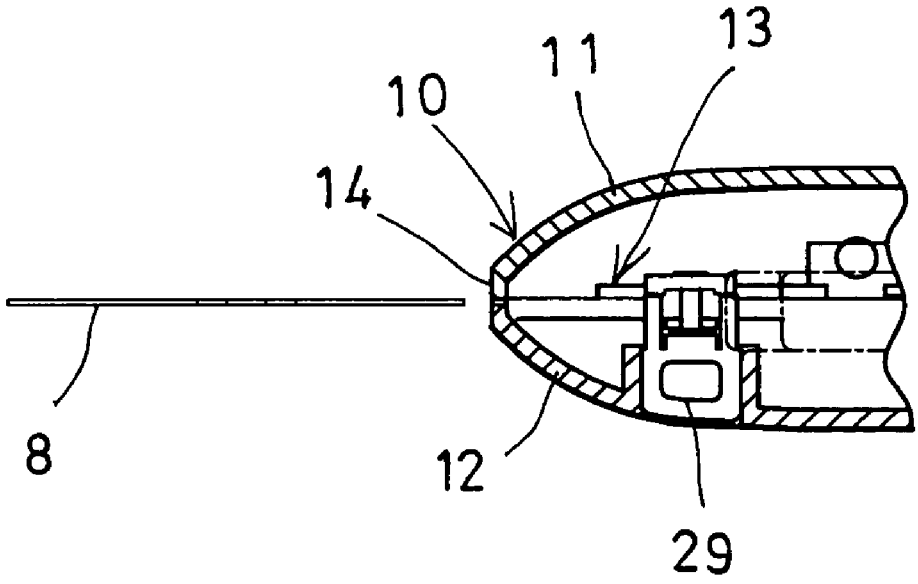
FIG. 10 is a cross sectional view similar to FIG. 9, illustrating the operation of the utility knife.

The blade carrier 20 includes a recessed space 25 formed therein for receiving and supporting a knife blade 8 and for anchoring the knife blade 8 to the blade carrier 20, and thus for allowing the knife blade 8 to be moved by the blade carrier 20 (FIGS. 2, 3, 5), and includes a spring catch 26 extended into the recessed space 25 of the blade carrier 20 for engaging with the knife blade 8 and for further anchoring or positioning the knife blade 8 to the blade carrier 20, and thus for allowing the knife blade 8 to be moved out of the housing 10 to conduct various cutting operations. A typical disengaging device 29 may be slidably attached to the front portion of the housing 10 for engaging with and for selectively disengaging the spring catch 26 from the knife blade 8 for allowing the knife blade 8 to be removed from the blade carrier 20 (FIG. 10). The above-described structure is typical and will not be described in further details.

The housing 10 further includes a casing 17 provided the rear portion of the housing 10 and having a groove 18 formed therein, and the blade carrier 20 includes a slot 27 formed therein and defined by one or more track rails 28 for slidably receiving or engaging with the casing 17 of the housing 10 and for further guiding the blade carrier 20 to stably move relative to the housing 10. The housing 10 further includes a compartment 19 formed therein, such as formed in the middle portion of one of the housing members 12 for receiving spare knife blades 80. A cover 30 is attachable and lockable to the housing 10 with a spring latch 31 for selectively enclosing the compartment 19 of the housing 10 and for retaining the spare knife blades 80 within the housing 10.

The compartment 19 and the spare knife blades 80 are offset from the recessed space 25 of the blade carrier 20 (FIG. 2) when the blade carrier 20 is moved into the housing 10, for preventing the spare knife blades 80 from being directly moved or forced into the recessed space 25 of the blade carrier 20, the spare knife blades 80 may be moved or forced into the recessed space 25 of the blade carrier 20 when one of the spare knife blades 80 is moved forwardly and aligned with the recessed space 25 of the blade carrier 20. The cover 30 may include one or more spring members 33 for engaging with the spare knife blades 80 and for biasing the spare knife blades 80 against the blade carrier 20, or for forcing one of the spare knife blades 80 into the recessed space 25 of the blade carrier 20 when the spare knife blade 80 has been moved forwardly and aligned with the recessed space 25 of the blade carrier 20.

Figure 2:
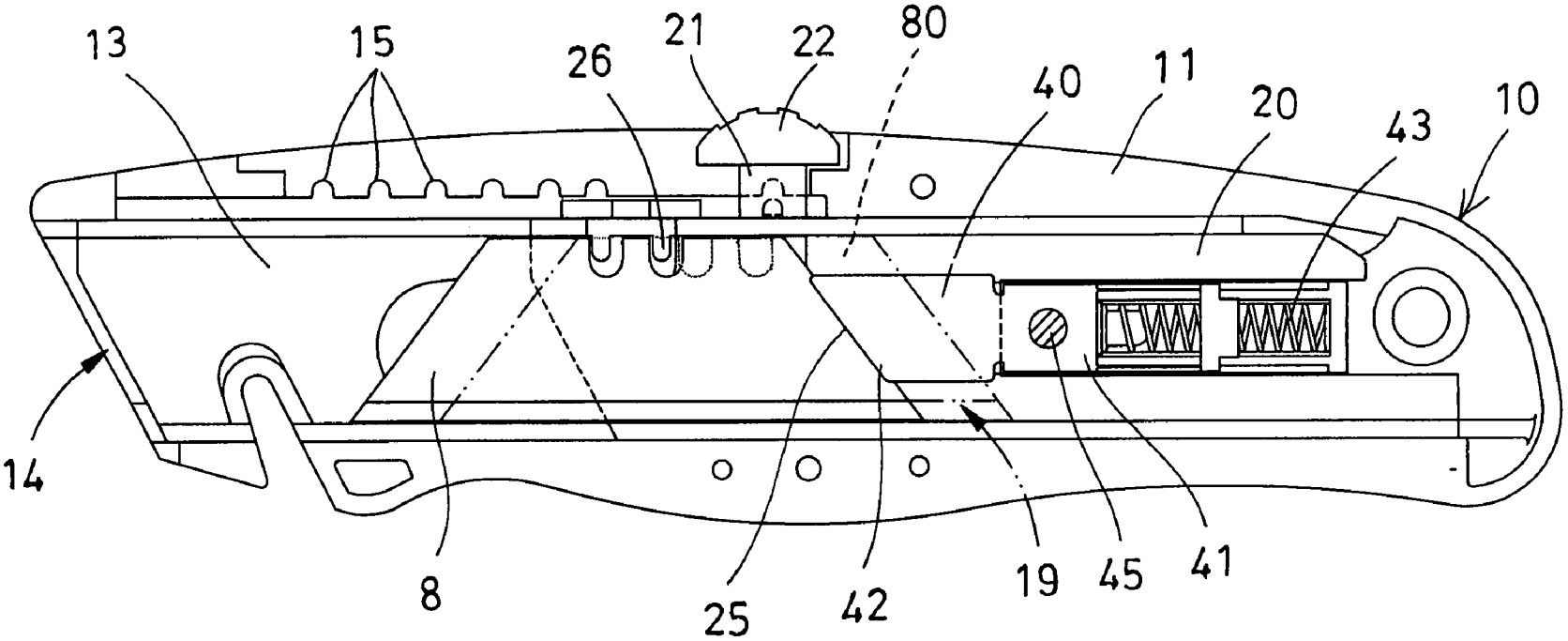
FIG. 2 is a side plan schematic view of the utility knife, in which one of the housing members has been removed for showing the inner structure of the utility knife.
Figure 6:
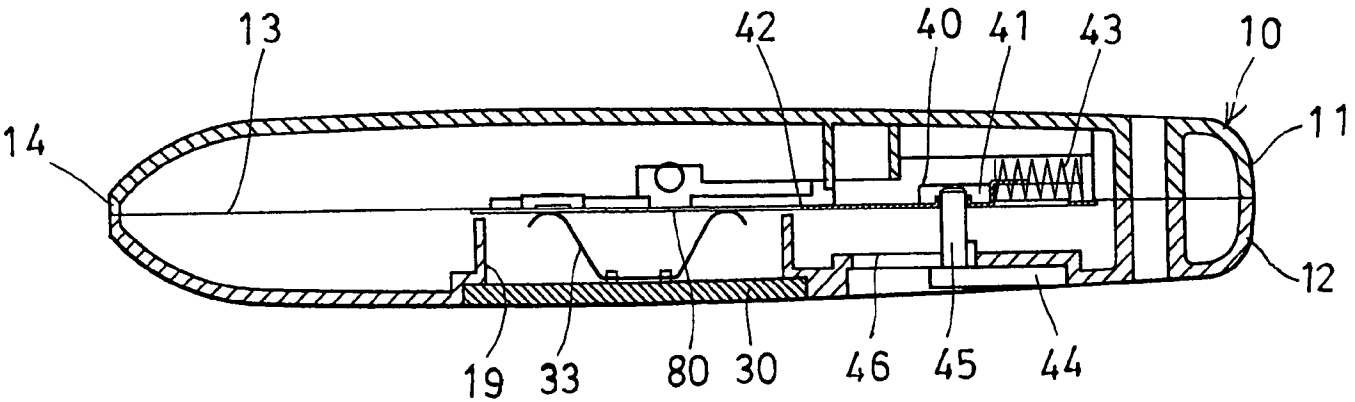
FIGS. 6, 7, 8 are cross sectional views similar to FIG. 5, illustrating the operation of the utility knife.
Figure 7:
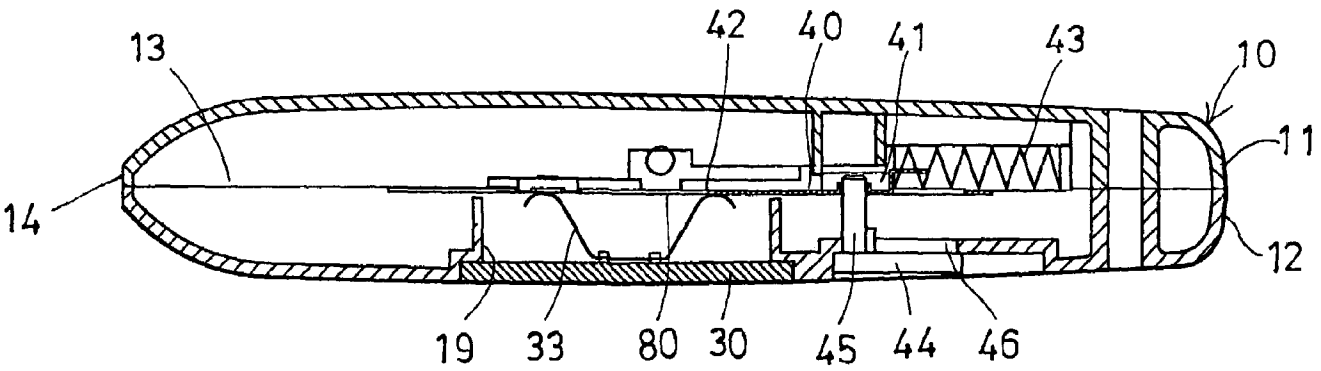
Figure 8:
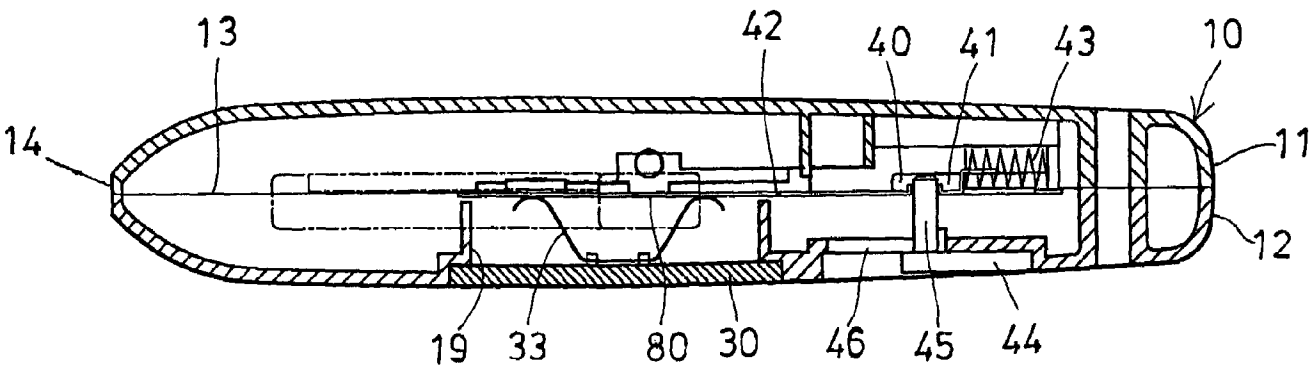

A pushing means or pusher 40 is slidably received in the housing 10, and includes a rear member or portion 41 slidably received in the slot 27 of the blade carrier 20 and/or slidably received in the groove 18 of the casing 17 or of the housing 10, and includes an inclined front edge 42 for engaging with one of the spare knife blades 80 (FIGS. 6, 8) and thus for moving the one spare knife blade 80 forwardly into the recessed space 25 of the blade carrier 20 (FIG. 7), and thus for allowing the one spare knife blade 80 to be biased or forced into the recessed space 25 of the blade carrier 20 by the spring members 33 and to be anchored to the blade carrier 20 with the spring catch 26. Another spring element 43 may be engaged between the pusher 40 and the casing 17 or the housing 10 for biasing the pusher 40 forwardly relative to the housing 10 and for offsetting the pusher 40 from the spare knife blades 80 (FIG. 2).

Figure 3:
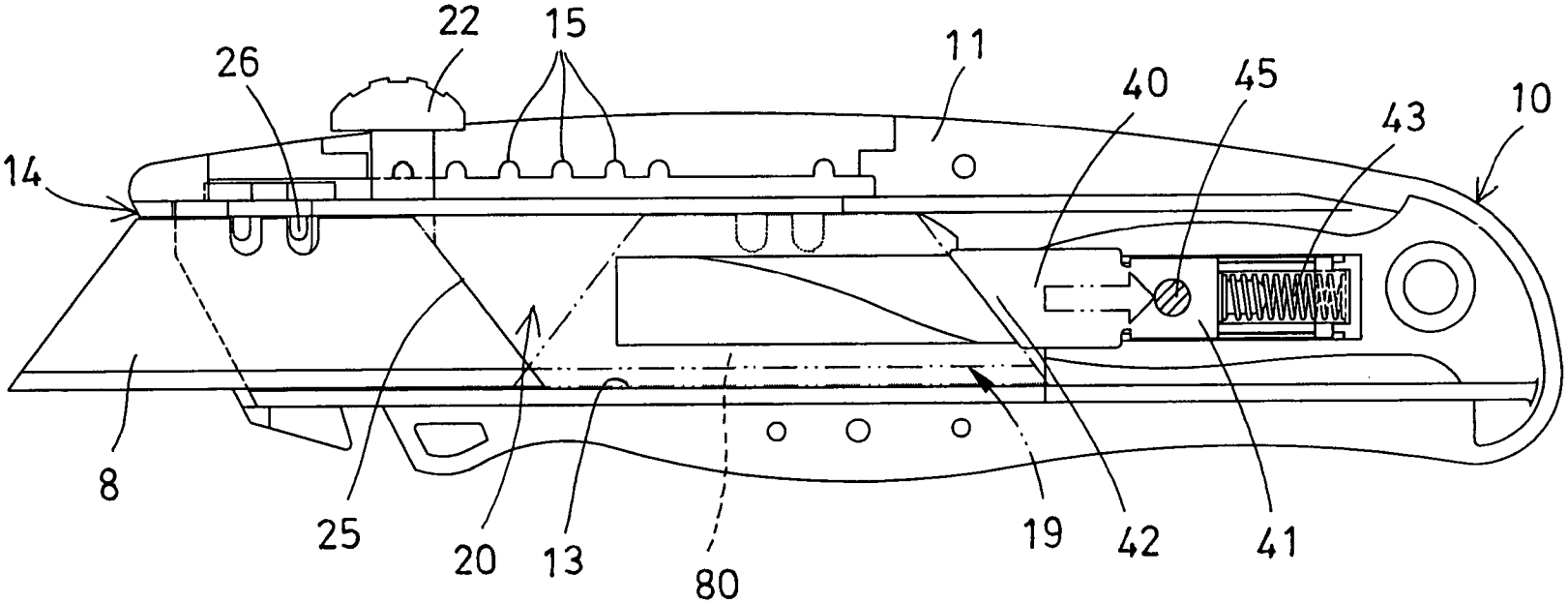
FIG. 3 is a side plan schematic view similar to FIG. 2, illustrating the operation of the utility knife.
Figure 4:
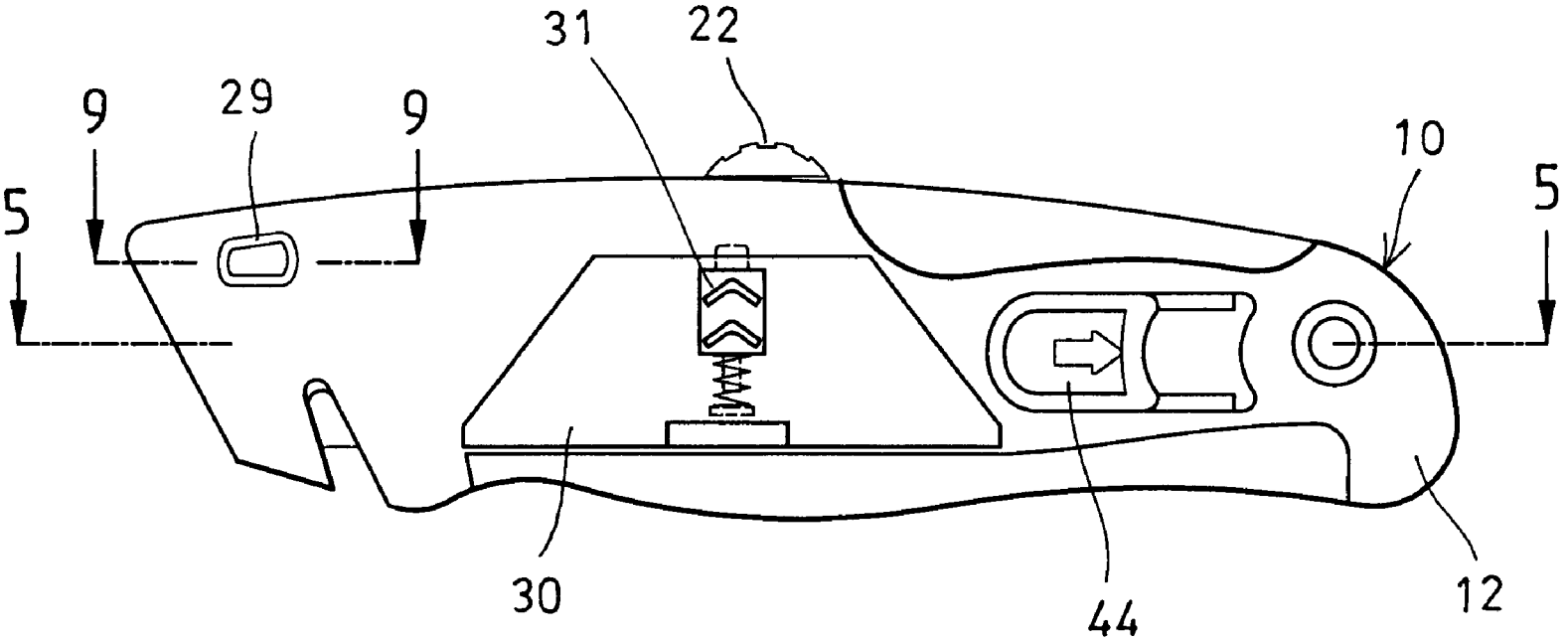
FIG. 4 is a side plan schematic view of the utility knife.
Figure 5:
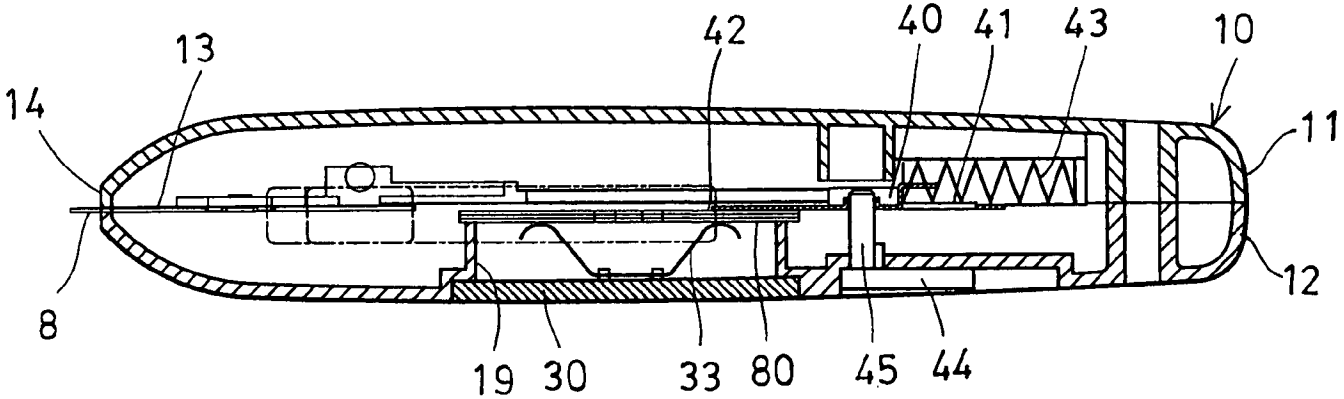
FIG. 5 is a cross sectional view of the utility knife taken along lines 5-5 of FIG. 4.

A hand grip 44 may further be provided and slidably attached to the housing 10 and includes a pin 45 extended therefrom and slidably engaged into an oblong hole 46 of the housing 10 and attached or secured to the pusher 40 for moving the pusher 40 rearwardly against the spring element 43 (FIGS. 3, 6), and thus for allowing the one spare knife blade 80 to be biased or forced to engage with the pusher 40, and then to be moved or fed into the recessed space 25 of the blade carrier 20 by the pusher 40 (FIGS. 2, 7, 8), and thus for allowing the one spare knife blade 80 to be moved into and out of the housing 10 to conduct various cutting operations (FIGS. 3, 5).

Figure 9:
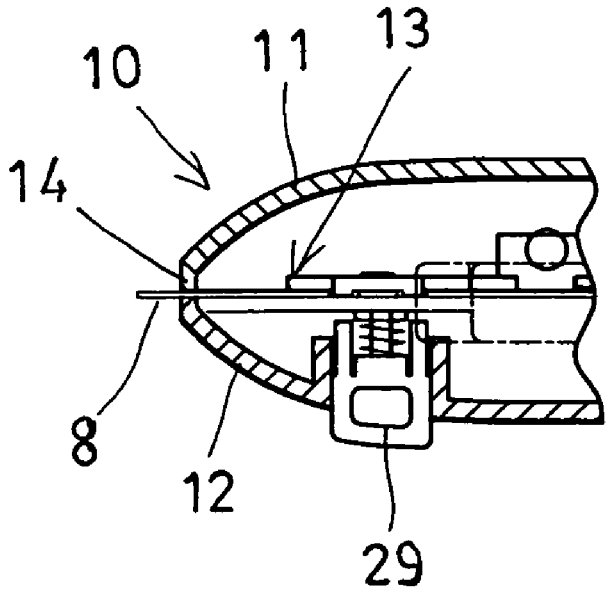
FIG. 9 is a cross sectional view of the utility knife taken along lines 9-9 of FIG. 4.

In operation, as shown in FIGS. 9 and 10, when the knife blade 8 has been worn out or is required to be removed or changed with a new knife blade, the knife blade 8 may be moved out of the front opening 14 of the housing 10 and may then be removed or disengaged from the blade carrier 20 with the disengaging device 29. The blade carrier 20 may then be moved into the housing 10 (FIG. 2) for selectively receiving one of the spare knife blades 80. At this moment, the pusher 40 is superposed with the spare knife blades 80 which is shown in dotted lines, or the spare knife blades 80 are biased onto the pusher 40. The pusher 40 may then be moved rearwardly against the spring element 43 with the hand grip 44 for allowing the pusher 40 to be moved and disengaged from the spare knife blades 80, and then for allowing the spare knife blades 80 to be moved and aligned with the pusher 40, and thus for allowing the spare knife blades 80 to be moved forwardly or fed into the recessed space 25 of the blade carrier 20 by the pusher 40.

Accordingly, the user is only required to move the pusher 40 rearwardly against the spring element 43 with the hand grip 44, and the pusher 40 may then be forced and moved forwardly relative to the blade carrier 20 by the spring element 43, in order to push or to feed one of the spare knife blades 80 into the recessed space 25 of the blade carrier 20, such that the spare knife blades 80 may be easily and quickly pushed or fed into the recessed space 25 of the blade carrier 20 with the pushing means or pusher 40, without opening the two halves or two housing members 11, 12 of the housing 10. The typical utility knives failed to provide a pushing means or pusher to directly pushing and feeding the spare knife blades 80 into the recessed space 25 of the blade carrier 20.

Accordingly, the utility knife in accordance with the present invention includes a feeding structure or device for easily pushing or feeding or changing a spare knife blade into a blade carrier without opening the handle or housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A utility knife comprising:

a housing including a channel and a front opening formed therein, and including a compartment formed therein for receiving at least one spare knife blade, a blade carrier slidably received in said channel of said housing for supporting and for moving a knife blade into and out of said front opening of said housing, and means for selectively pushing and feeding said at least one spare knife blade into said blade carrier, said pushing means including a pusher slidably received in said housing and having an edge for engaging with said at least one spare knife blade and for moving said at least one spare knife blade to said blade carrier, and including a spring element engaged with said pusher for moving said pusher relative to said housing and to offset said pusher from said at least one spare knife blade.

2. The utility knife as claimed in claim 1, wherein said housing includes a groove formed therein, said pusher includes a member slidably received in said groove of said housing.

3. The utility knife as claimed in claim 1, wherein said edge of said pusher is an inclined edge.

4. The utility knife as claimed in claim 1, wherein a hand grip is slidably attached to said housing and secured to said pusher for moving said pusher relative to said housing.

5. The utility knife as claimed in claim 1, wherein said housing includes a cover attached thereto for enclosing said compartment of said housing and for retaining said at least one spare knife blade within said housing.

6. The utility knife as claimed in claim 5, wherein said cover includes a spring latch for attaching and locking said cover to said housing.

7. The utility knife as claimed in claim 5, wherein said cover includes a spring member for engaging with said at least one spare knife blade and for biasing said at least one spare knife blade against said blade carrier.

8. The utility knife as claimed in claim 1, wherein said blade carrier includes a recessed space formed therein for receiving and supporting said at least one spare knife blade and includes a spring catch extended into said recessed space of said blade carrier for engaging with said at least one spare knife blade and for anchoring and positioning said at least one spare knife blade to said blade carrier.

9. The utility knife as claimed in claim 8, wherein a disengaging device is slidably attached to said housing for engaging with and for selectively disengaging said spring catch from said at least one spare knife blade and for allowing said at least one spare knife blade to be selectively removed from said blade carrier.

10. The utility knife as claimed in claim 1, wherein said housing includes a plurality of cavities and a passage formed in said housing and communicating with said channel of said housing, said blade carrier includes an extension extended therefrom and slidably engaged in said passage of said housing for guiding said blade carrier to move relative to said housing, and includes a knob provided on top of said extension for moving said blade carrier relative to said housing, and includes a spring arm having a key extended therefrom for selectively engaging with either of said cavities of said housing and for anchoring and positioning said blade carrier to said housing at selected positions.

11. A utility knife comprising:

a housing including a channel and a front opening formed therein, and including a compartment formed therein for receiving at least one spare knife blade, and including a groove formed therein, a blade carrier slidably received in said channel of said housing for supporting and for moving a knife blade into and out of said front opening of said housing, and means for selectively pushing and feeding said at least one spare knife blade into said blade carrier, said pushing means including a pusher slidably received in said housing and having an edge for engaging with said at least one spare knife blade and for moving said at least one spare knife blade to said blade carrier, and said pusher including a member slidably received in said groove of said housing, and said blade carrier including a slot formed therein and defined by at least one track rail for slidably receiving said member of said pusher.

12. A utility knife comprising:

a housing including a channel and a front opening formed therein, and including a compartment formed therein for receiving at least one spare knife blade, a blade carrier slidably received in said channel of said housing for supporting and for moving a knife blade into and out of said front opening of said housing, and means for selectively pushing and feeding said at least one spare knife blade into said blade carrier, said pushing means including a pusher slidably received in said housing and having an edge for engaging with said at least one spare knife blade and for moving said at least one spare knife blade to said blade carrier, a hand grip slidably attached to said housing and secured to said pusher for moving said pusher relative to said housing, and said hand grip including a pin extended therefrom and slidably engaged into an oblong hole of said housing and attached to said pusher.

* * * * *